US010576741B2

(12) United States Patent
Hammura et al.

(10) Patent No.: US 10,576,741 B2
(45) Date of Patent: Mar. 3, 2020

(54) LIQUID EJECTION HEAD AND LIQUID EJECTION APPARATUS

(71) Applicant: CANON KABUSHIKI KAISHA, Tokyo (JP)

(72) Inventors: Akiko Hammura, Tokyo (JP); Yoshiyuki Nakagawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/014,600

(22) Filed: Jun. 21, 2018

(65) Prior Publication Data

US 2019/0001672 A1 Jan. 3, 2019

(30) Foreign Application Priority Data

Jun. 29, 2017 (JP) ..... 2017-127557

(51) Int. Cl.
*B41J 2/14* (2006.01)
*B41J 2/18* (2006.01)

(52) U.S. Cl.
CPC ..... *B41J 2/14032* (2013.01); *B41J 2/1404* (2013.01); *B41J 2/14056* (2013.01); *B41J 2/14088* (2013.01); *B41J 2/14145* (2013.01); *B41J 2/14201* (2013.01); *B41J 2/18* (2013.01); *B41J 2202/11* (2013.01); *B41J 2202/12* (2013.01)

(58) Field of Classification Search
CPC ..... B41J 2/14032; B41J 2/14088; B41J 2/18; B41J 2/14201; B41J 2202/12; B41J 2/1652
See application file for complete search history.

(56) References Cited

U.S. PATENT DOCUMENTS

2013/0076835 A1* 3/2013 Oikawa ..... B41J 2/1404 347/54
2013/0233939 A1 9/2013 Uezawa
2018/0194134 A1* 7/2018 Kawakubo ..... B41J 2/145

FOREIGN PATENT DOCUMENTS

EP 0 900 659 A2 3/1999
WO 2011/146069 A1 11/2011
WO 2016/175865 A1 11/2016
WO WO-2016175865 A1 * 11/2016 ..... B41J 2/1404

OTHER PUBLICATIONS

Extended European Search Report dated Oct. 31, 2018, in European Patent Application No. 18176451.5.
U.S. Appl. No. 15/992,667, Takuro Yamazaki Toru Nakakubo Kazuhiro Yamada Yoshiyuki Nakagawa Yoshiniro Hamada Koichi Ishida Shingo Okushima, filed May 30, 2018.
U.S. Appl. No. 15/995,493, Toru Nakakubo Takuro Yamazaki Kazuhiro Yamada Yoshiyuki Nakagawa, filed Jun. 1, 2018.
(Continued)

*Primary Examiner* — Anh T Vo
(74) *Attorney, Agent, or Firm* — Venable LLP

(57) ABSTRACT

An ejection energy generating element is provided in a first pressure chamber so that a liquid in the first pressure chamber is ejected from an ejection port. A pressurization energy generating element is provided in a second pressure chamber so that the liquid in the first pressure chamber is pressurized. An opening area of a hole open to the second pressure chamber is smaller than an opening area of the ejection port.

17 Claims, 9 Drawing Sheets

(56) References Cited

OTHER PUBLICATIONS

U.S. Appl. No. 16/000,238, Yoshiyuki Nakagawa Takuro Yamazaki Kazuhiro Yamada Tom Nakakubo, filed Jun. 5, 2018.
U.S. Appl. No. 16/006,312, Takuro Yamazaki Toru Nakakubo Kazuhiro Yamada Yoshiyuki Nakagawa Akiko Hammura, filed Jun. 12, 2018.

* cited by examiner

RATIO OF PRESSURE PROPAGATION CALCULATED FROM RATIO OF INERTIAL RESISTANCE

| | DIAMETER OF HOLE (19) | |
|---|---|---|
| | ϕ11μm | ϕ20μm |
| CIRCULATION SUPPLY FLOW PATH (16) | 39% | 23% |
| CONNECTION FLOW PATH (26) | 32% | 19% |
| HOLE (19) | 29% | 58% |

LIQUID EJECTION HEAD AND LIQUID EJECTION APPARATUS

BACKGROUND OF THE INVENTION

Field of the Invention

The present invention relates to a liquid ejection head and a liquid ejection apparatus capable of ejecting a liquid such as ink.

Description of the Related Art

International Publication No. 2011/146069 discloses an inkjet printing head as a liquid ejection head that is capable of ejecting liquid ink in a pressure chamber from an ejection port by pressurizing the ink supplied into the pressure chamber with an ejection energy generating element. This printing head has a circulation path for circulating the ink in the pressure chamber, and the circulation path is provided with the same as the pressure chamber for ink ejection, the ejection energy generating element, and the ejection port. The printing head is configured such that flow energy for circulating or stirring the ink in the pressure chamber is generated by the ejection energy generating element provided on the circulation path. The circulation or stirring of the ink in the pressure chamber is effective to suppress the occurrence of an ink ejection failure attributable to thickening of the ink during volatile ink component evaporation from the ejection port.

In International Publication No. 2011/146069, the pressure chamber, the same as the ejection energy generating element, and the ejection port that are configured for ink ejection are used so that the ink in the circulation path flows. Accordingly, efficient ink circulation or stirring cannot be performed with ease.

SUMMARY OF THE INVENTION

The invention provides a liquid ejection head and a liquid ejection apparatus allowing a liquid such as ink to efficiently flow.

In the first aspect of the present invention, there is provided a liquid ejection head comprising:

a first pressure chamber and a second pressure chamber, one end portion of the first pressure chamber being connected to a liquid supply path through a first flow path, one end portion of the second pressure chamber being connected to the liquid supply path through a second flow path, the other end portion of the first pressure chamber and the other end portion of the second pressure chamber being communicated with each other by a communication path;

an ejection port open to the first pressure chamber;

a hole open to the second pressure chamber;

an ejection energy generating element provided in the first pressure chamber so that a liquid in the first pressure chamber is ejected from the ejection port; and a pressurization energy generating element provided in the second pressure chamber so that the liquid in the first pressure chamber is pressurized, wherein an opening area of the hole is smaller than an opening area of the ejection port.

In the second aspect of the present invention, there is provided a liquid ejection apparatus comprising:

the liquid ejection head according to the first aspect of the present invention;

a supply unit configured to supply a liquid to the liquid supply path of the liquid ejection head; and a control unit configured to control the ejection energy generating element and the pressurization energy generating element.

With the invention, a satisfactory liquid ejection state can be maintained by means of an efficient flow of a liquid in a liquid ejection head.

Further features of the present invention will become apparent from the following description of exemplary embodiments with reference to the attached drawings.

DESCRIPTION OF THE EMBODIMENTS

Hereinafter, embodiments of the invention will be described with reference to accompanying drawings.

First Embodiment

Figure 1:
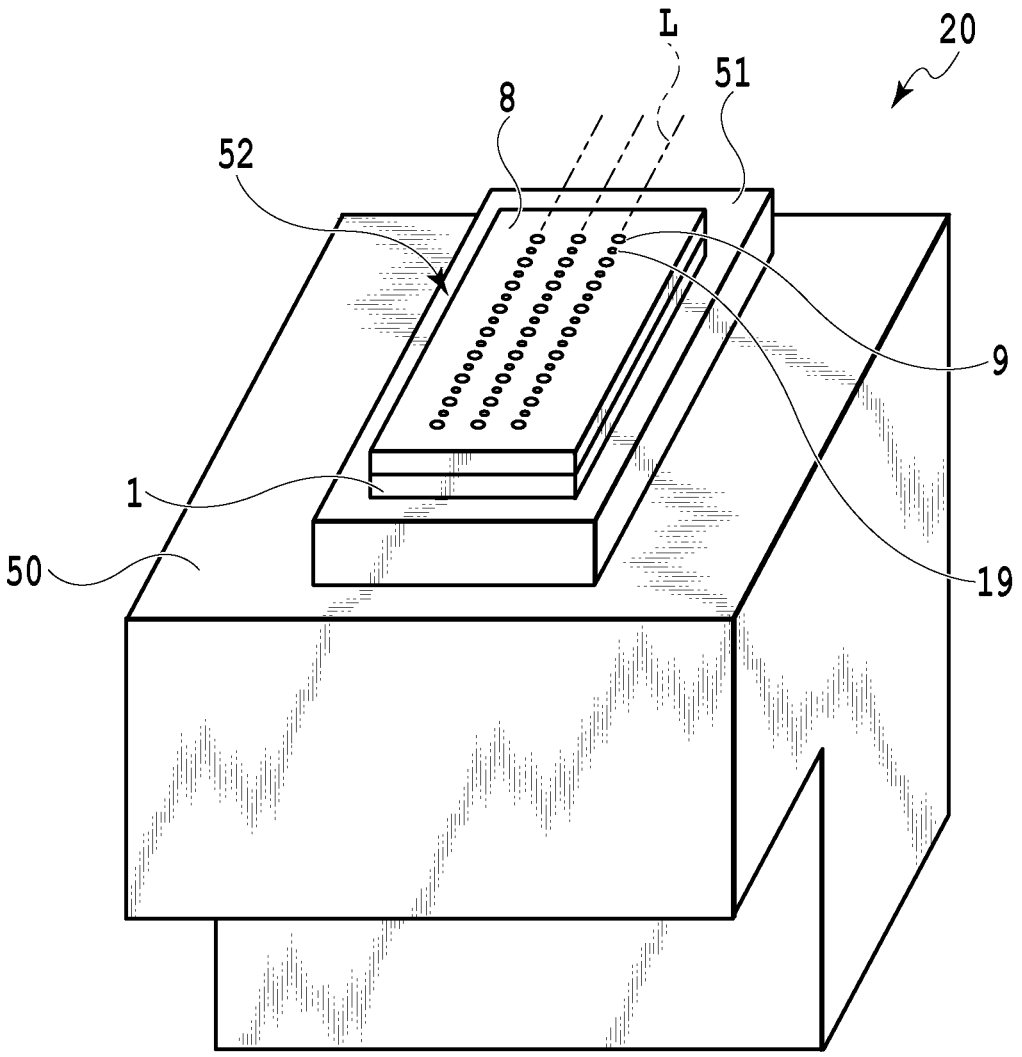
FIG. 1 is a perspective view of a printing head according to a first embodiment of the invention.
Figure 2A:
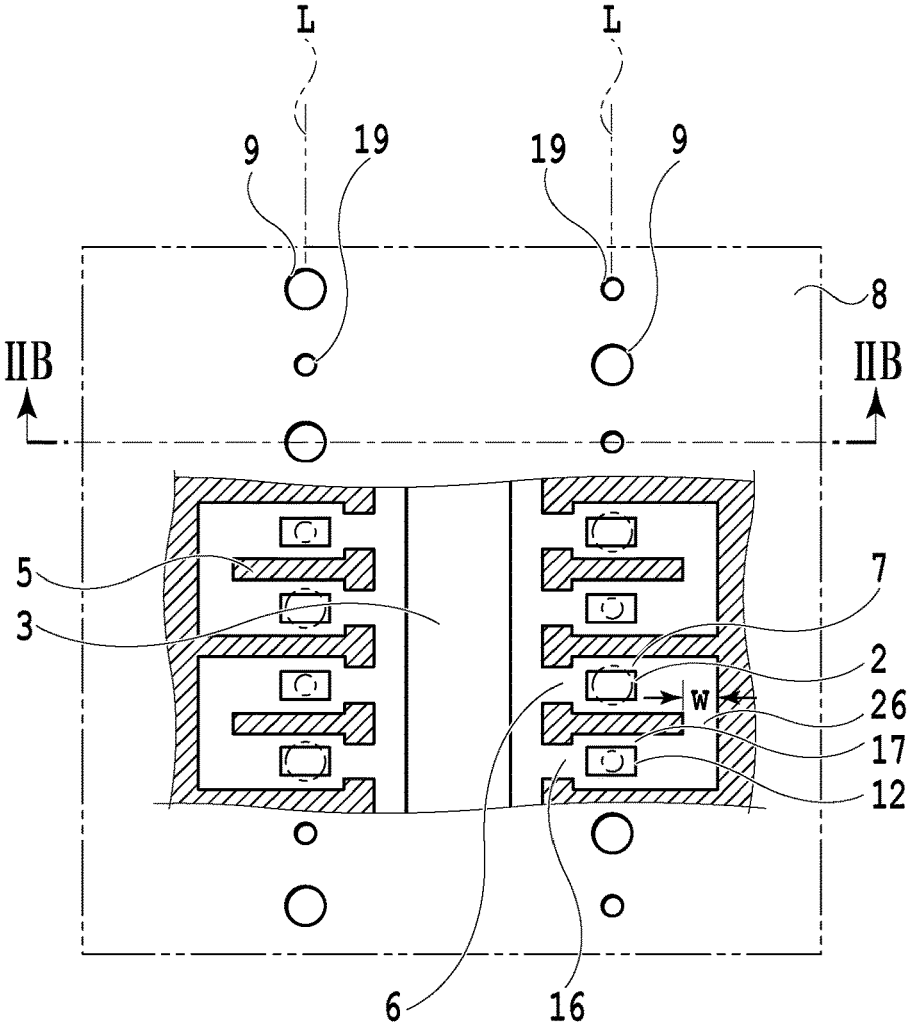
FIG. 2A is an explanatory diagram of a printing element of the printing head in FIG. 1.

FIG. 1 is a schematic perspective view of an inkjet printing head 20 as a liquid ejection head, and a connecting member 51 and a printing element 52 are disposed on a head main body 50. An orifice plate 8 that has a plurality of ejection ports (first ejection ports) 9 is provided on a substrate 1 of the printing element 52. The plurality of ejection ports 9 form an ejection port array L. FIG. 2A is a plan view of the printing element 52 in which the orifice plate 8 is partially cut out, and FIG. 2B is a sectional view taken along line IIB-IIB of FIG. 2A.

(Configuration of Printing Element)

Figure 2B:
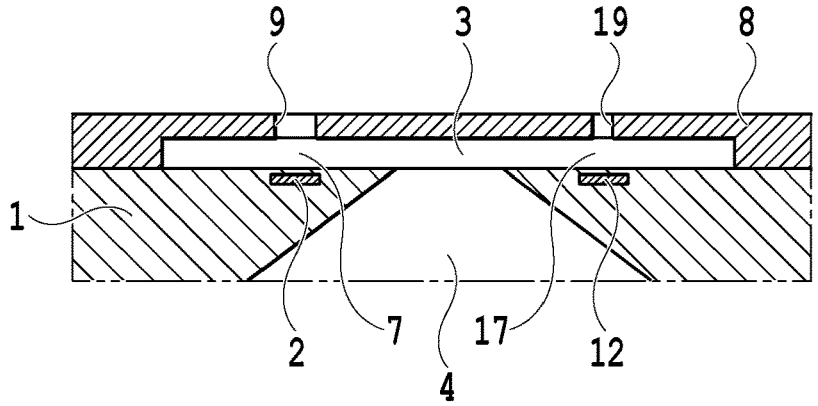
FIG. 2B is a sectional view taken along line IIB-IIB of FIG. 2A.

As illustrated in FIGS. 2A and 2B, a plurality of heating elements (electrothermal transducers) 2 corresponding to the plurality of ejection ports 9 are arranged in the substrate 1 as ink ejection energy generating elements. A plurality of pressure chambers (first pressure chambers) 7 corresponding to the heating elements 2 and a plurality of flow paths (first flow paths) 6 supplying ink (liquid) from a common liquid chamber (supply path) 3 into the pressure chambers 7 are formed by a nozzle forming member 5. The ink in the pressure chamber 7 is foamed by the heating element 2 being driven to generate heat, and the ink is ejected from the ejection port 9 open to the pressure chamber 7 by the foaming energy being used. One end portion of the pressure chamber 7 communicates with the flow path 6, and the other end portion of the pressure chamber 7 communicates with a connection flow path (communication path) 26 for ink circulation. A piezoelectric element or the like also can be used as the ejection energy generating element.

A plurality of heating elements (electrothermal transducers) 12 for circulation (hereinafter also referred to as a "circulation heating elements") are arranged in the substrate 1 as pressurization energy generating elements for ink pressurization. In addition, a plurality of pressure chambers (second pressure chambers) for circulation (hereinafter also referred to as a "circulation pressure chamber") 17 corresponding to the heating elements 12 are formed by the nozzle forming member 5. A circulation supply flow path (second flow path) 16 allows one end portion of the circulation pressure chamber 17 to communicate with the common liquid chamber 3, and the connection flow path 26 allows the other end portion of the circulation pressure chamber 17 to communicate with the pressure chamber 7. The ink in the circulation pressure chamber 17 is foamed by the circulation heating element 12 being driven to generate heat, and the ink is pressurized and circulated as described later by the foaming energy being used. That is, the circulation heating element (pressurization energy generating element) 12 provided in the circulation pressure chamber (second pressure chamber) 17 pressurizes the ink (liquid) in the circulation pressure chamber (second pressure chamber) 17 so as to pressurize the ink in the pressure chamber (first pressure chamber) 7. As a result, the circulation heating element 12 pressurizes the ink in the pressure chamber 7. Ink is supplied to the common liquid chamber 3 from a supply port 4 penetrating the substrate 1. A member (not illustrated) forming a filter for preventing intrusion of foreign matters such as garbage into the pressure chambers 7 and 17 may be arranged in the ink flow paths 6 and 16.

The ejection port 9 is formed at a position in the orifice plate 8 that faces the heating element 2. As described above, the ink in the pressure chamber 7 is ejected from the ejection port 9 by the heating element 2 being driven. In addition, a through hole 19 (second ejection port) is formed at a position in the orifice plate 8 that faces the circulation heating element 12. In the case of this embodiment, the gap between the ejection port 9 and the hole 19 and the gap between the heating element 2 and the circulation heating element 12 in the extension direction of the ejection port array L are gaps corresponding to a printing resolution of 600 dpi. In addition, the thickness of the orifice plate 8 is 11 μm, the diameter of the ejection port 9 is 20 μm, the amount of the ink that is ejected from the ejection port 9 is approximately 5 ng, and the diameter of the hole 19 is 11 μm. In addition, a width W (refer to FIG. 2A) of the connection flow path 26 is 20 μm and the height of the connection flow path 26 is 14 μm. The ejection port 9 is open to the first pressure chamber 7, and the hole 19 is open to the second pressure chamber 17.

(Circulating Flow of Ink)

The pressure wave at a time when the ink in the circulation pressure chamber 17 is foamed by the heating element 12 being driven is dispersed and propagated in a total of three directions, that is, the direction toward the connection flow path 26, the direction toward the circulation supply flow path 16, and the direction toward the hole 19. An ink flow in the arrow direction in FIG. 3A results from the pressure propagated toward the circulation supply flow path 16, and a circulating ink flow is generated in the pressure chamber 7 as a result. Subsequently, during defoaming of the ink in the circulation pressure chamber 17, a pressure opposite in direction to the pressure during the foaming is generated. As a result, an ink flow from the circulation pressure chamber 17 toward the connection flow path 26 is generated as indicated by the arrows in FIG. 3B. The ink in the pressure chamber 7 is stirred as a result of this change in ink flow.

In this embodiment, the ink flow from the pressure chamber 7 toward the circulation supply flow path 16 was bigger than the ink flow from the connection flow path 26 toward the pressure chamber 7 in a case where the circulating ink flow resulted from the foaming and defoaming of the ink in the circulation pressure chamber 17 as described above. Accordingly, the circulating ink flow in the arrow direction in FIG. 3A was likely to be generated. In addition, the circulating ink flow in the arrow direction in FIG. 3B also can be generated depending on continuous driving of the heating element 12 and the shape of the connection flow path 26. In addition, a piezoelectric element or the like that is capable of pressurizing the ink in the circulation pressure chamber 17 can be used instead of the heating element 12 as the pressurization energy generating element. In this case, the direction of the circulating ink flow can be changed by the piezoelectric element or the like being driven such that the pressure in the direction toward the circulation supply flow path 16 and the pressure in the direction toward the connection flow path 26 are asymmetrically applied to the ink in the circulation pressure chamber 17. In other words, the circulating ink flow can be generated in any of the directions illustrated in FIGS. 3A and 3B.

(Advantage of Hole)

The heating element 12 can be driven such that ink is ejected from the hole 19 and can be driven without ink being ejected from the hole 19. In other words, ink can be ejected from the hole 19 by the heating element 12 being driven such that pressurization energy required for ink ejection from the hole 19 is generated (first driving mode). In this case, the heating element 12 functions as an ink ejection energy generating element. In addition, no ink is ejected from the hole 19 by the heating element 12 being driven such that energy less than the pressurization energy required for ink ejection from the hole 19 is generated (second driving mode). The first driving mode or the second driving mode as described above can be selected as the driving mode of the heating element 12.

Figure 3A:
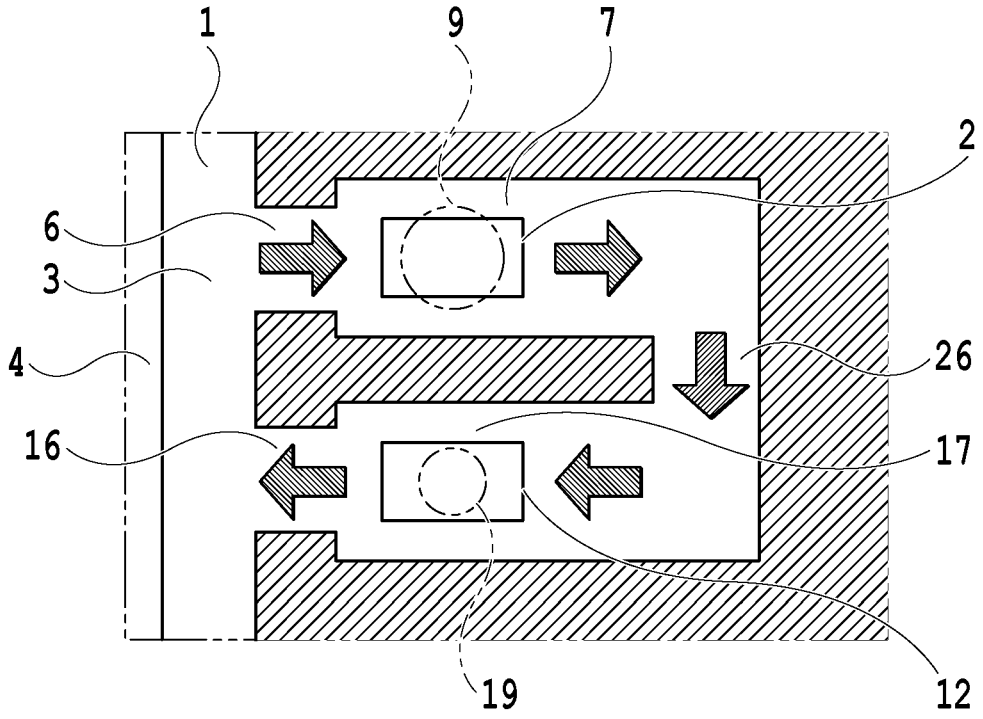
FIGS. 3A and 3B are explanatory diagrams of an ink flow direction in the printing element in FIG. 2A.
Figure 3B:
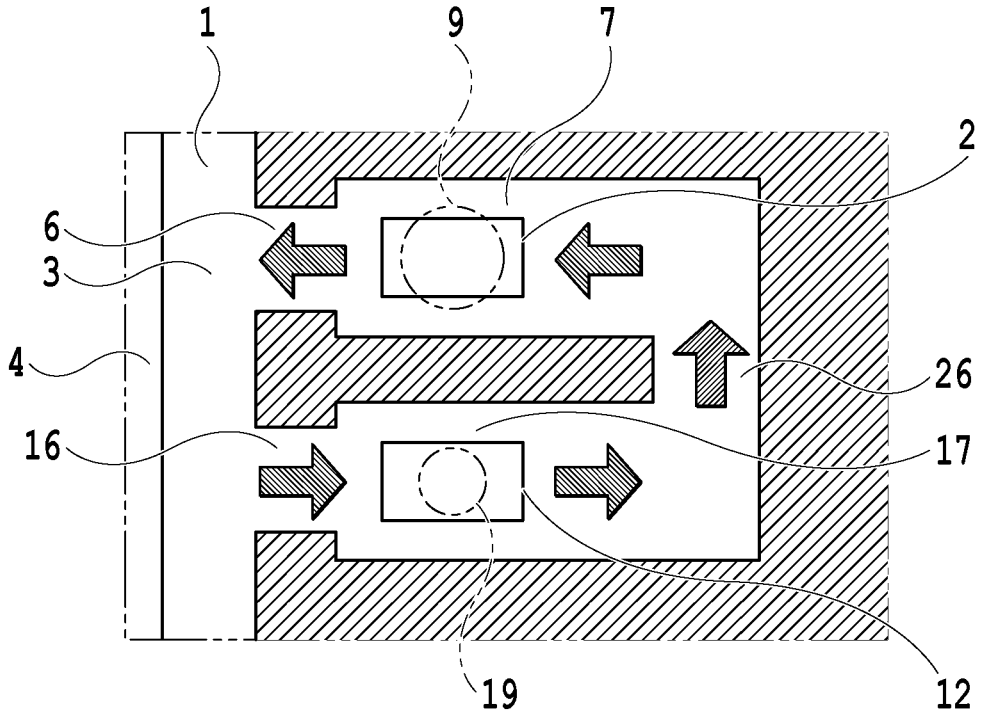

The bubbles generated in the ink in the circulation pressure chamber 17 in the first driving mode are larger than the bubbles generated in the ink in the circulation pressure chamber 17 in the second driving mode. Accordingly, in the first driving mode, a larger pressure is transmitted into the connection flow path 26 and a circulating ink flow with a higher flow velocity can be generated. During defoaming of the ink in the circulation pressure chamber 17, in the meantime, the ink flow in the arrow direction in FIG. 3B is generated such that the circulation pressure chamber 17 is refilled with the ink discharged from the inside of the circulation pressure chamber 17 as a result of foaming. This ink flow is generated while the circulation pressure chamber 17 is refilled with the ink and continues even after the refilling by vibration of the meniscus of the ink formed in the opening portion of the hole 19 being transmitted to the ink in the connection flow path 26. By the hole 19 being formed, the time when the ink flow is generated from the effect of the vibration of the meniscus of the ink in the hole 19 becomes longer and ink circulation and stirring are allowed to proceed more than in a case where the hole 19 is not formed. In addition, by the hole 19 being formed, the time when the ink flow is generated from the effect of the vibration of the meniscus of the ink formed in the hole 19 becomes longer also in the second driving mode. In other words, the meniscus of the ink formed in the hole 19 vibrates by being raised as a result of foaming and settled as a result of defoaming, and thus the time when the ink flow is generated can be lengthened by the vibration.

(Opening Area of Hole)

As described above, the pressure wave at a time when the ink in the circulation pressure chamber 17 is foamed is dispersed and propagated in a total of three directions, that is, the direction toward the connection flow path 26, the direction toward the circulation supply flow path 16, and the direction toward the hole 19. The ratios of the pressure waves propagated in the directions are determined by the inertial resistance of the ink in each of the directions. By the inertial resistance of the ink in the hole 19 being increased by the diameter of the hole 19 (11 μm) being set to be less than the diameter of the ejection port 9 (20 μm) as in this embodiment, the pressure fluctuation of the ink in the circulation pressure chamber 17 can be efficiently propagated in the circulation direction of the ink. Accordingly, the circulating ink flow can be further increased.

Figures 5A, 5B:
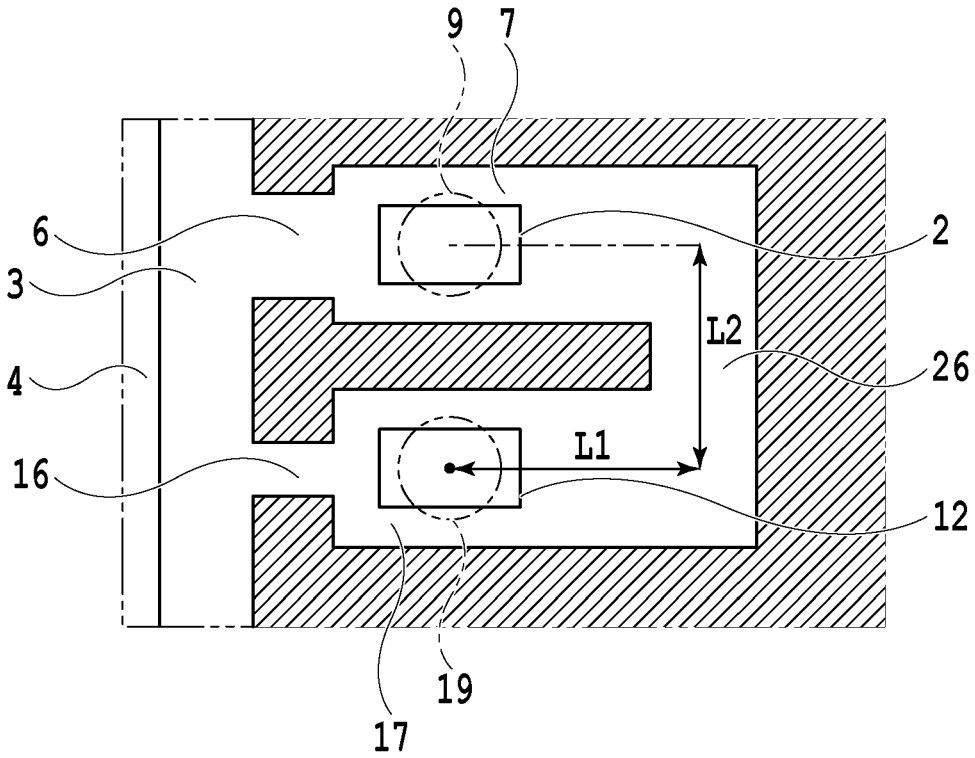
FIGS. 5A and 5B are explanatory diagrams of a comparative example with respect to the printing element in FIG. 2A.

FIG. 5A is an explanatory diagram of a main part of a printing element according to a comparative example, in which both the hole 19 and the ejection port 9 have a diameter of 20 μm. FIG. 5B is an explanatory diagram showing the pressure propagation ratios calculated from the ratio of the inertial resistance of the ink in a case where the hole 19 is 11 μm and 20 μm in diameter. In other words, the inertial resistance of the ink in the connection flow path 26 was calculated based on a distance L1 (refer to FIG. 5A) of 40 μm and a distance L2 (refer to FIG. 5A) of 42 μm. The distance L1 is the distance from the center of the circulation heating element 12 to the connection flow path 26, and the distance L2 is the distance for the connection flow path 26 to be connected to the pressure chamber 7. In a case where the diameter of the hole 19 was 20 μm as in the comparative example illustrated in FIG. 5A, the ratio of the pressure propagation in the circulation pressure chamber 17 was 58% for the direction toward the hole 19, 19% for the direction toward the connection flow path 26, and 23% for the direction toward the circulation supply flow path 16 as in FIG. 5B. In the case of this comparative example, most of the pressure in the circulation pressure chamber 17 is propagated in the direction toward the hole 19.

In a case where the diameter of the hole 19 was 11 μm as in this embodiment, the ratio of the pressure propagation in the circulation pressure chamber 17 was 29% for the direction toward the hole 19, 32% for the direction toward the connection flow path 26, and 39% for the direction toward the circulation supply flow path 16 as in FIG. 5B. In this manner, the ratio of the pressure propagation in the direction toward the connection flow path 26 could be raised by the ratio of the pressure propagation in the direction toward the hole 19 being reduced to the lowest. As the diameter of the hole 19 decreases, the pressure propagated to the hole 19 in the second driving mode of the circulation heating element 12 decreases and the pressure propagated to the connection flow path 26 can be increased. In this manner, as the diameter of the hole 19 decreases, the inertial resistance of the hole 19 increases and the pressure transmitted to the connection flow path 26 can be increased.

An ejection amount of approximately 1 ng is preferable in a case where the circulation heating element 12 is driven such that ink is ejected from the hole 19 (first driving mode). In this example, the diameter of the hole 19 could be reduced down to approximately 9 μm for the ejection amount to be realized. In a case where the shape of the connection flow path 26 is as in this example, the ratio of the pressure propagated to the connection flow path 26 increased by at least 10% by the inertial resistance in the direction toward the hole 19 being increased to at least 1.48 times the inertial resistance in the direction toward the ejection port 9. Also, the ratio of the pressure propagated to the connection flow path 26 can be changed in accordance with the shape of the connection flow path 26. An effect from a decrease in the opening area of the hole 19 is easily achieved in a case where the inertial resistance in the direction toward the hole 19 is at least 1.3 times the inertial resistance in the direction toward the ejection port 9. Preferably, the second flow path 16 is longer in distance than the first flow path 6.

(Another Advantage of Hole)

In the printing head 20 as in this example, thickened ink in the printing head 20 is sometimes ejected from the ejection port 9 before an image printing operation (preliminary ejection). In this case, the thickened ink can be more efficiently ejected by the preliminary ink ejection being performed from not only the ejection port 9 but also the hole 19. Since the hole 19 according to this example has a diameter of 11 μm, the amount of the ink droplet ejected from the hole 19 is approximately 2 ng. Since the amount of the ink ejected from the ejection port 9 is approximately 5 ng, the amount of the preliminary ink ejection is more easily adjusted, by the preliminary ejection from the ejection port 9 and the preliminary ejection from the hole 19 being combined with each other, than in a case where the preliminary ink ejection is performed with the ejection port 9 alone. Accordingly, the amount of the preliminary ink ejection can be easily adjusted to the minimum required discharge amount and the amount of ink discarded as a result of the preliminary ejection can be reduced as a result.

The preliminary ink ejection also results in a circulating ink flow, and thus thickened ink in the pressure chamber 7, the connection flow path 26, and the circulation pressure chamber 17 can be replaced with new ink by means of preliminary ejection of a smaller amount of ink. In a case where preliminary ink ejection is performed on an image printing region, the amount of ink preliminarily ejected from the small-diameter hole 19 is small, and thus the ink preliminarily ejected from this hole 19 is unlikely to be conspicuous in the image printing region. Accordingly, the state of ink ejection from the ejection port 9 during the image printing operation can be satisfactorily maintained by a circulating ink flow being generated by ink being preliminarily ejected from the hole 19 alone.

(Drive Timing of Circulation Heating Element)

The ink ejection state of the ejection port 9 can be satisfactorily maintained at all times by the circulation heating element 12 being driven at all times and a circulating ink flow being generated in the pressure chamber 7 at all times. This, however, results in an increase in energy consumption. Accordingly, it is preferable to drive the heating element 12 in accordance with the drive timing of the heating element 2.

In a case where the ink ejection pause time of the ejection port 9 is relatively short, the circulation heating element 12 does not have to be driven twice or more. In this case, it is preferable that the heating element 2 is driven after an ink flow is generated in the pressure chamber 7 as a result of pressure propagation caused by the circulation heating element 12 being driven and after the meniscus of the ink formed in the ejection port 9 is raised and settled. This drive timing of the heating element 2 causes the ink in the ejection port 9 to be stirred by meniscus vibration and allows the effect of thickened ink resulting from volatile ink component evaporation from the ejection port 9 to be kept to a minimum. Furthermore, changes in amount and speed of ink ejection from the ejection port 9 attributable to the effect of meniscus vibration in the ejection port 9 can be suppressed.

In a case where the ink ejection pause time of the ejection port 9 is relatively long, the drive time and the drive timing of the circulation heating element 12 are set in accordance with the distance between the heating element 12 and the pressure chamber 7. Even when the amount of ink thickened by volatile ink component evaporation from the ejection port 9 (concentrated liquid) is at its maximum, the thickened ink is present only in the flow path 6, the pressure chamber 7, the connection flow path 26, the circulation pressure chamber 17, and the circulation supply flow path 16. Accordingly, the thickened ink between the heating element 12 and the pressure chamber 7 and the thickened ink in the pressure chamber 7 are allowed to flow by the circulation heating element 12 being driven and the state of ink ejection from the ejection port 9 can be satisfactorily maintained.

Figure 4A:
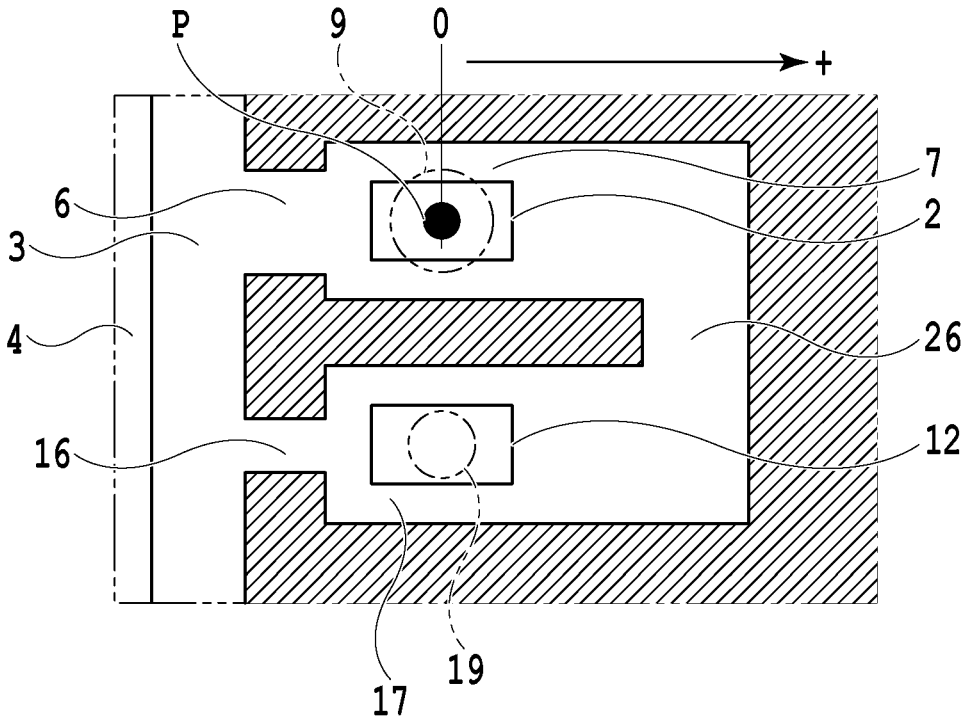
FIGS. 4A and 4B are explanatory diagrams of an ink flow distance in the printing element in FIG. 2A.
Figure 4B:
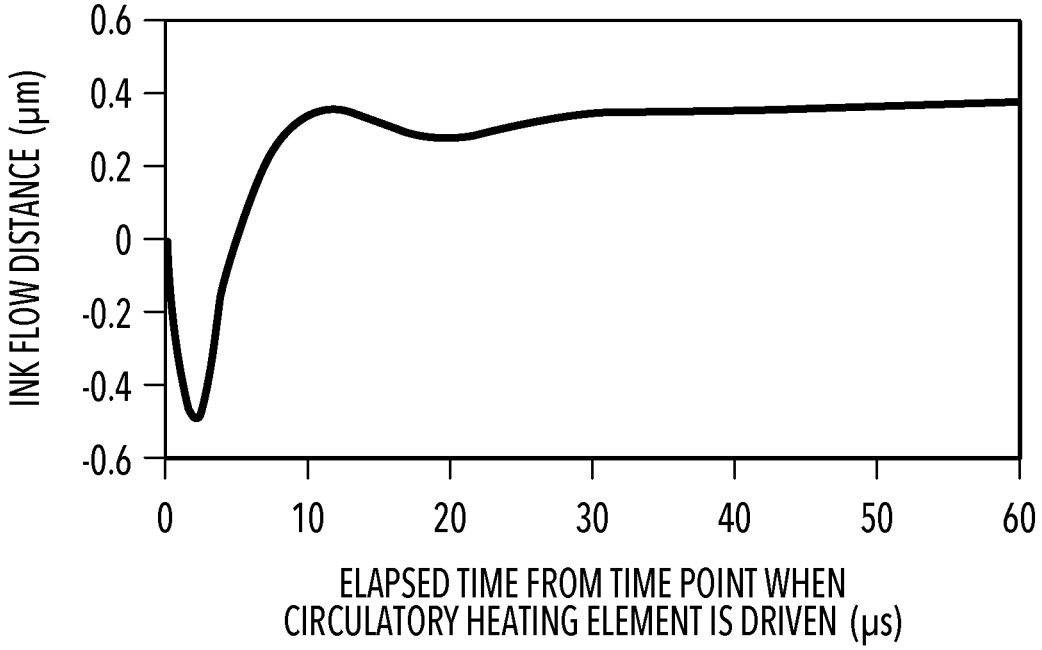

FIGS. 4A and 4B are explanatory diagrams showing a drive timing for driving the circulation heating element 12 as described above. In a case where the circulation heating element 12 is driven such that no ink is ejected from the hole 19 (second driving mode), a flow distance of the ink at a P point in the pressure chamber 7 illustrated in FIG. 4A is calculated, and the result of the calculation is illustrated in FIG. 4B. The horizontal axis in FIG. 4B represents the elapsed time from the time point when the heating element 12 is driven, and the vertical axis in FIG. 4B represents the flow distance of the ink at the P point.

After the elapse of 50 μs from the drive time point of the heating element 12, the ink at the P point flows by approximately 0.4 μm in the + direction in FIG. 4A, that is, the direction toward the connection flow path 26. In a case where the distance from the flow path 6 to the pressure chamber 7 is 22 μm and the distance from the pressure chamber 7 to the connection flow path 26 is 64 μm, the pressure chamber 7 is filled with unthickened ink by the ink in the pressure chamber 7 flowing by 86 μm in the + direction in FIG. 4A. Specifically, the heating element 12 may be driven for approximately 10.5 ms in a case where the heating element 12 is driven every 50 μs with a drive frequency of 20 kHz. In other words, the state of ink ejection from the ejection port 9 can be satisfactorily maintained by driving of the circulation heating element 12 being initiated 10.5 ms ahead of the drive time point of the heating element 2. In this example, the calculation was performed with the ink having a viscosity of approximately 2 cp, a density of 1 g/cm$^3$, and a static surface tension of 36 mN/m. Depending on ink types, a similar effect may be achieved from a shorter drive time of the circulation heating element 12 or driving for a longer period of time may be required. Accordingly, it is preferable to drive the circulation heating element 12 once at least 1 ms ahead of the drive time point of the heating element 2. In addition, it can be seen from FIG. 4B that a circulating ink flow is generated after the elapse of 5 μs from the drive time point of the circulation heating element 12. Accordingly, it is preferable to drive the circulation heating element 12 once at least 5 μs ahead of the drive time point of the heating element 2.

(Printing of Image)

The circulation heating element 12 is used for image printing, that is, the heating element 12 is driven such that ink is ejected from the hole 19 (first driving state) in a case where a fine photo image, a very small letter, or the like is printed. Effective in this case is ejection of 5 ng of ink from the ejection port 9 and 2 ng of ink from the hole 19. In this case, the state of ink ejection from the hole 19 can be satisfactorily maintained by the circulating ink flow generated in the connection flow path 26. Driving of the heating element 2, in the meantime, results in circulating ink flow generation in the connection flow path 26 and the circulation pressure chamber 17, and thus the heating element 2 also can be used as means for generating a circulating flow in the ink ejected from the hole 19. Accordingly, in a case where the circulation heating element 12 is used for image printing, it is preferable to drive the heating element 2 such that a circulating ink flow is generated.

Second Embodiment

Figure 6A:
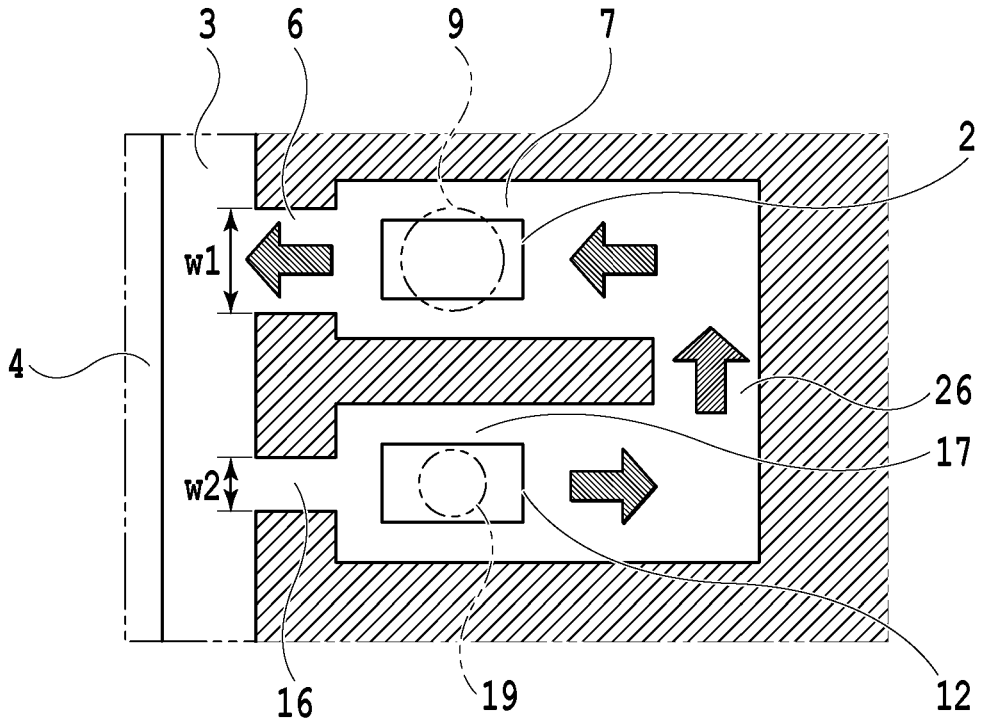
FIGS. 6A and 6B are explanatory diagrams of a printing element of a printing head according to a second embodiment of the invention.
Figure 6B:
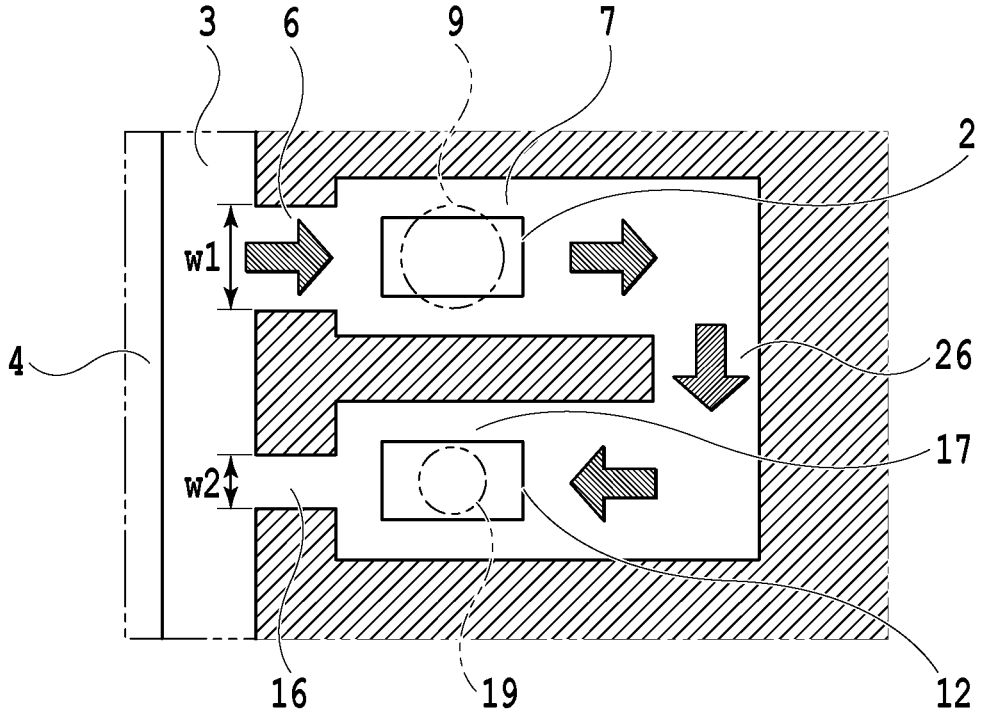

The printing head 20 according to the present embodiment is identical in basic configuration to the first embodiment, and thus only the characteristic configuration thereof will be described below. FIGS. 6A and 6B, which are similar to FIGS. 3A and 3B, are diagrams of the printing element 52 of the printing head 20 according to the present embodiment.

In this example, a width W1 of the flow path 6 is 20 μm and a width W2 of the circulation supply flow path 16 is 10 μm, which is less than the width W1 of the flow path 6. As a result, the inertial resistance of the ink can be bigger in the circulation supply flow path 16 than in the flow path 6, the ratio of the pressure that is generated by driving of the circulation heating element 12 and transmitted to the connection flow path 26 can be increased, and the circulating ink flow can be more efficiently generated. During foaming of the ink in the circulation pressure chamber 17, a circulating ink flow from the circulation pressure chamber 17 toward the connection flow path 26 is generated as indicated by the arrows in FIG. 6A. During defoaming of the ink in the circulation pressure chamber 17, the pressure relationship between the circulation pressure chamber 17 and the connection flow path 26 changes and a circulating ink flow from the connection flow path 26 toward the circulation pressure chamber 17 is generated as indicated by the arrows in FIG. 6B. The ink in the circulation pressure chamber 17 is likely to flow toward the relatively wide flow path 6 and unlikely to flow toward the relatively narrow circulation supply flow path 16, and thus circulating flows in the arrow directions that are illustrated in FIGS. 6A and 6B are likely to be generated. In terms of calculation, the ratio of the pressure propagated to the pressure chamber 7 during foaming of the ink in the circulation pressure chamber 17 is improved by at least 10% by, for example, the inertial resistance of the ink in the circulation supply flow path 16 being at least 1.5 times the inertial resistance of the ink in the flow path 6.

A circulation energy generating element such as a piezoelectric element can be used instead of the circulation heating element 12 as in the first embodiment described above. Also in this case, the circulating flows in the arrow directions that are illustrated in FIGS. 6A and 6B can be generated.

Third Embodiment

Figure 7:
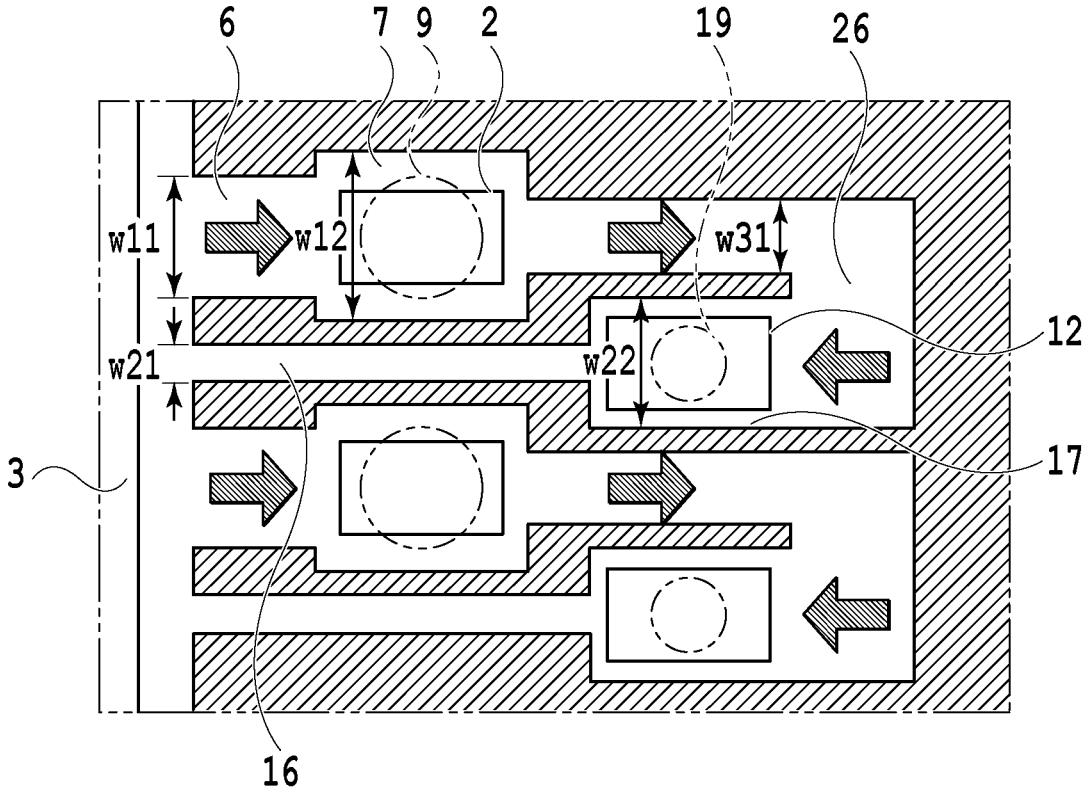
FIG. 7 is an explanatory diagram of a printing element of a printing head according to a third embodiment of the invention.

The printing head 20 according to the present embodiment is identical in basic configuration to the first embodiment, and thus only the characteristic configuration thereof will be described below. FIG. 7, which is similar to FIG. 3A, is a diagram of the printing element 52 of the printing head 20 according to the present embodiment.

In this example, the gap between the ejection port 9 and the hole 19 and the gap between the heating element 2 and the circulation heating element 12 in the extension direction of the ejection port array L (refer to FIG. 1) are gaps corresponding to a printing resolution of 1,200 dpi. In addition, a width W11 of the flow path 6 is 20 μm, a width W12 of the pressure chamber 7 is 28 μm, the diameter of the ejection port 9 is 20 μm, a width W21 of the circulation supply flow path 16 is 6 μm, a width W22 of the circulation pressure chamber 17 is 20 μm, and the diameter of the hole 19 is 11 μm. In addition, a width W31 of the connection flow path 26 is 12 μm, the height of the connection flow path 26 is 14 μm, and the thickness of the orifice plate 8 is 11 μm.

By the hole 19 being small in diameter and the width W21 of the circulation supply flow path 16 being small as described above, the ejection port 9 and the hole 19 can be arranged with a gap corresponding to a printing resolution of 1,200 dpi. The time required for ink refilling is shortened by the volume of the ink ejected from the hole 19 being reduced, and thus the effect of the small width W21 of the circulation supply flow path 16 is likely to be limited. A circulating flow in the arrow direction in FIG. 7 is generated during defoaming of the ink in the circulation pressure chamber 17. At that time, the ratio of the ink flowing into the pressure chamber 7 through the flow path 6 from the common liquid chamber 3 increases relating to the ink flowing into the circulation pressure chamber 17 through the circulation supply flow path 16 from the common liquid chamber 3. Accordingly, the circulating flow in the arrow direction in FIG. 7 becomes more likely to be generated. In addition, the ink refilling time that is required after ejection of approximately 5 ng of ink from the ejection port 9 becomes longer than the ink refilling time that is required after ink ejection from the hole 19. For high-speed driving of the heating element 2, it is preferable to shorten the ink refilling time required after ink ejection from the ejection port 9 by arranging the pressure chamber 7 closer to the common liquid chamber 3 and shortening the flow path 6 as in this example.

A circulation energy generating element such as a piezoelectric element can be used instead of the circulation heating element 12 as in the first embodiment described above. Also in this case, the circulating flow in the arrow direction that is illustrated in FIG. 7 and a circulating flow in the opposite direction can be generated.

Fourth Embodiment

Figure 8A:
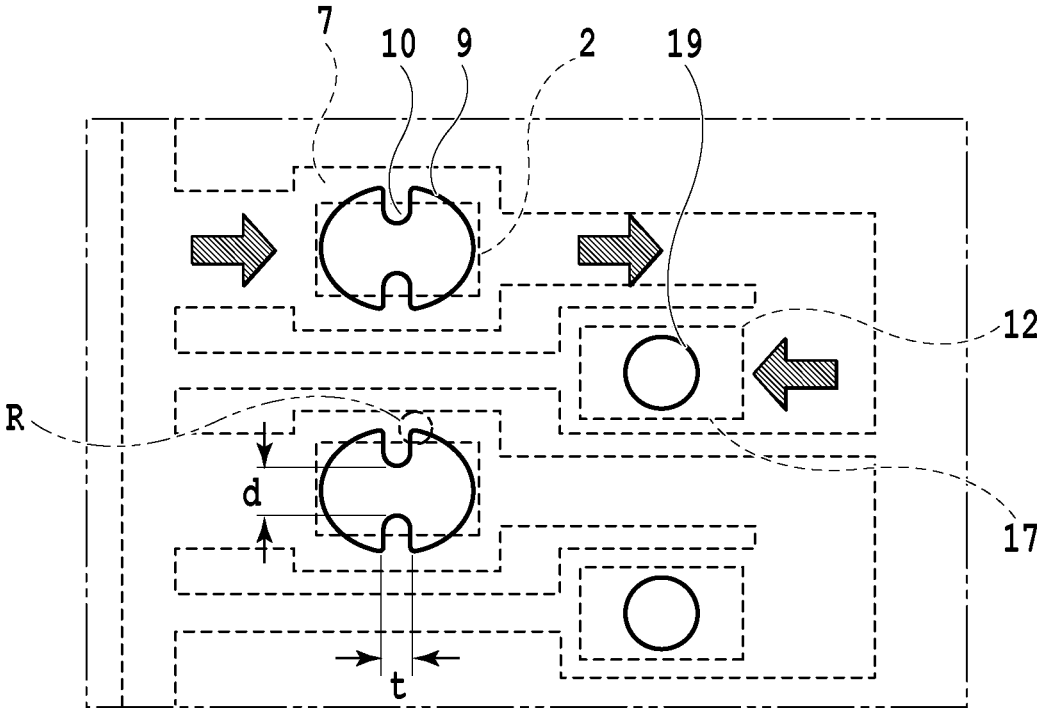
FIGS. 8A and 8B are explanatory diagrams of a printing element of a printing head according to a fourth embodiment of the invention.
Figure 8B:
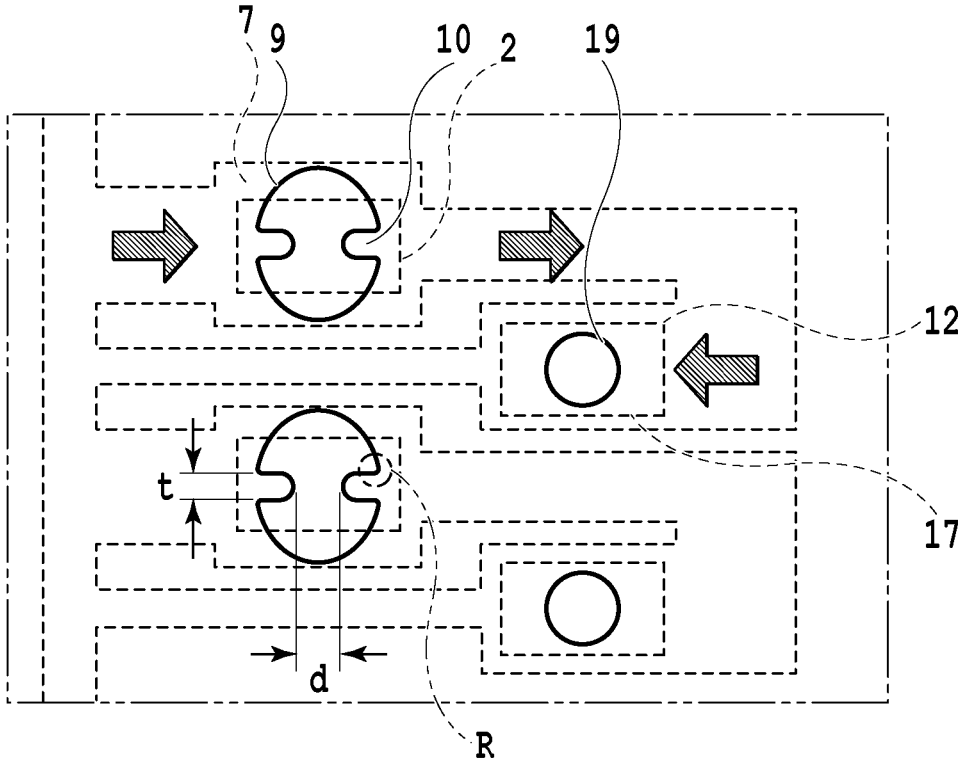

The shape of the ejection port 9 is the only difference between the present embodiment and the third embodiment. FIGS. 8A and 8B are diagrams showing different configuration examples of the ejection port 9 according to the present embodiment from the orifice plate 8 (refer to FIG. 1) side.

Each of the ejection ports 9 illustrated in FIGS. 8A and 8B has a pair of projection portions 10 protruding from the inner surface of the ejection port 9 toward the inside of the ejection port 9. In addition, the projection portion 10 protrudes from the inner surface of the ejection port 9 toward the center of the ejection port 9 and extends in the length direction of the ejection port 9 (thickness direction of the orifice plate 8). The projection portion 10 in the ejection port 9 illustrated in FIG. 8A protrudes in the direction crossing the circulating ink flow in the arrow direction in FIG. 8A, and the projection portion 10 in the ejection port 9 illustrated in FIG. 8B protrudes in the direction along the circulating ink flow in the arrow direction in FIG. 8B. The arrows in FIGS. 8A and 8B indicate the direction of the circulating flow generated during defoaming of the ink in the circulation pressure chamber 17. A circulating flow opposite in direction to the arrows in FIGS. 8A and 8B may be generated during foaming of the ink in the circulation pressure chamber 17 and depending on how the circulation heating element 12 is driven.

The meniscus force of the ink formed in the ejection port 9 is increased when the opening diameter of the ejection port 9 is partially reduced by the ejection port 9 being provided with the projection portion 10 as described above. Shaking of the ink surface in the ejection port 9 is suppressed by this meniscus force, and thus the trailing edge (trailing part) of the main droplet of the ink ejected from the ejection port 9 can be shortened. As a result, micro ink droplet generation attributable to fragmentation of the trailing edge of the main ink droplet can be suppressed. In this example, a width "t" of the projection portion 10 is 4 μm, a gap "d" between the projection portions 10 facing each other is 7.7 μm, and the part where the ejection port 9 and the projection portion 10 are connected to each other is 2 μm in R.

A circulation energy generating element such as a piezoelectric element can be used instead of the circulation heating element 12 as in the first embodiment described above. Also in this case, the circulating flow in the arrow direction that is illustrated in FIGS. 8A and 8B and a circulating flow in the opposite direction can be generated.

(Configuration Example of Inkjet Printing Apparatus)

Figure 9A:
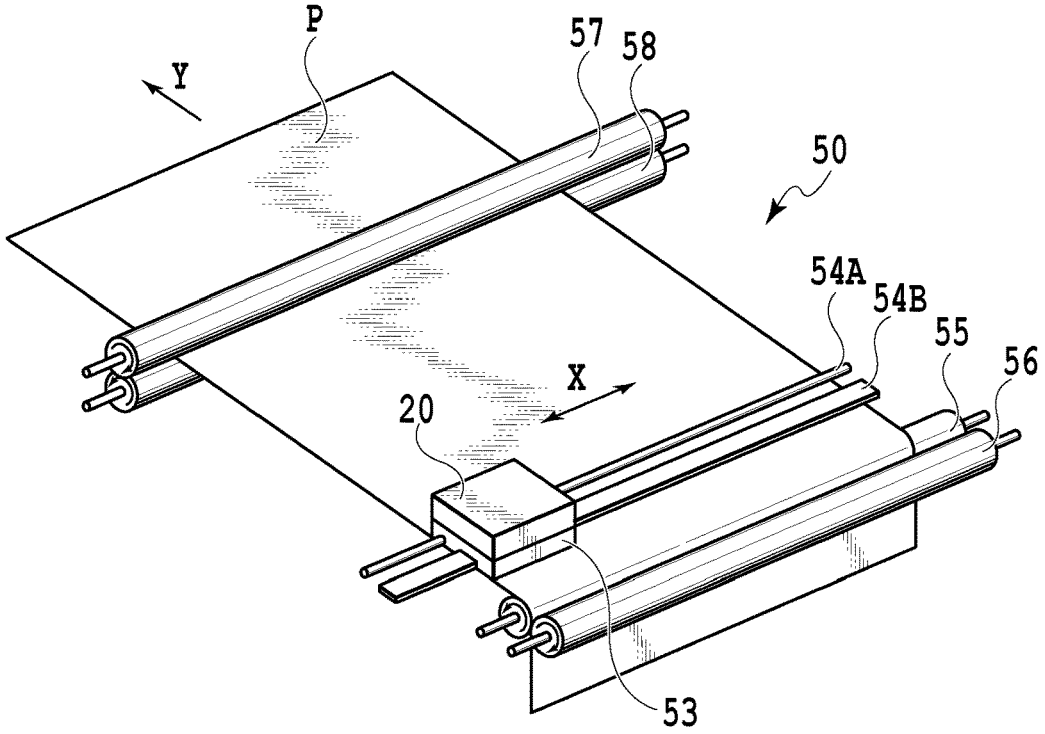
FIGS. 9A and 9B are explanatory diagrams of a printing apparatus provided with the printing head according to the embodiments of the invention.

A printing head (liquid ejection head) H according to the embodiments described above can be used in various inkjet printing apparatuses (liquid ejection apparatus) such as so-called serial scan type and full line type inkjet printing apparatuses. FIG. 9A illustrates a configuration example of a serial scan type inkjet printing apparatus, in which the printing head 20 according to the embodiments described above is removably mounted on a carriage 53 moving in the arrow X direction (main scanning direction) illustrated in FIG. 9A. A printing medium P is transported in the arrow Y direction (sub-scanning direction) by rolls 55, 56, 57, and 58, and the carriage 53 is guided by guide members 54A and 54B. An image is printed on the printing medium P by an operation in which the printing head 20 ejects ink while moving in the main scanning direction with the carriage 53 and an operation in which the printing medium P is transported in the sub-scanning direction being repeated.

Figure 9B:
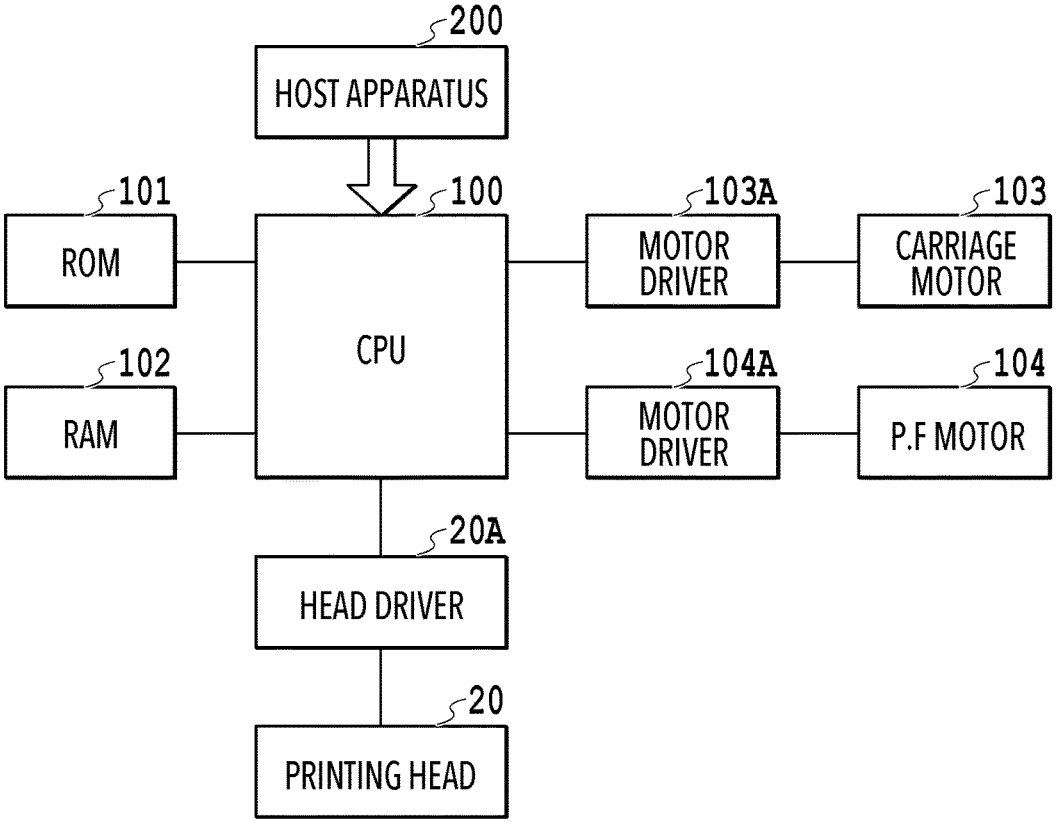

FIG. 9B is a block diagram of a control system for the inkjet printing apparatus illustrated in FIG. 9A. A CPU (control unit) 100 executes operation control processing, data processing of the printing apparatus, and so on. Programs for the processing procedures and so on are stored in a ROM 101, and a RAM 102 is used as, for example, a work area for executing the processing. The heating elements 2 and 12 of the printing head 20 are driven via a head driver 20A. Image printing is performed by the drive data (image data) and the drive control signal (heat pulse signal) of the heating element 2 and/or the heating element 12 being supplied to the head driver 20A. The CPU 100 controls a carriage motor 103 for driving the carriage 53 in the main scanning direction via a motor driver 103A and controls a paper feed (PF) motor 104 for transporting the printing medium P in the sub-scanning direction via a motor driver 104A. In addition, as described above, the CPU 100 controls the drive timings of the heating elements 2 and 12 as described above.

Other Embodiment

In the embodiments described above, one circulation pressure chamber 17 communicates with one pressure chamber 7. However, a plurality of circulation pressure chambers 17 may communicate with one pressure chamber 7 and a plurality of pressure chambers 7 may communicate with one circulation pressure chamber 17 instead. The circulation heating element 12 may be capable of pressurizing ink such that at least flowing and stirring of the ink in the pressure chamber 7 are possible.

The invention is not limited to the inkjet printing head and the inkjet printing apparatus according to the embodiments described above and can be widely applied as a liquid ejection head and a liquid ejection apparatus capable of ejecting various liquids. In addition, the ejection energy generating element and the pressurization energy generating element are not limited to the heating element (heater) according to the embodiments described above and a piezoelectric element and so on also can be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-127557, filed Jun. 29, 2017, which is hereby incorporated by reference herein in its entirety.

What is claimed is:

1. A liquid ejection head comprising:

a first pressure chamber and a second pressure chamber, one end portion of the first pressure chamber being connected to a liquid supply path through a first flow path, one end portion of the second pressure chamber being connected to the liquid supply path through a second flow path, the other end portion of the first pressure chamber and the other end portion of the second pressure chamber being communicated with each other by a communication path;

an ejection port allowing communication between the first pressure chamber and atmosphere;

a hole allowing communication between the second pressure chamber and atmosphere;

an ejection energy generating element provided in the first pressure chamber so that a liquid in the first pressure chamber is ejected from the ejection port; and a pressurization energy generating element provided in the second pressure chamber so that the liquid in the first pressure chamber is pressurized, wherein an opening area of the hole is smaller than an opening area of the ejection port, and wherein an inertial resistance of the liquid in the hole is at least 1.3 times an inertial resistance of the liquid in the ejection port.

2. The liquid ejection head according to claim 1, wherein the second flow path is longer in distance than the first flow path.

3. The liquid ejection head according to claim 1, wherein the pressurization energy generating element is capable of pressurizing the liquid without ejecting the liquid in the second pressure chamber from the hole.

4. The liquid ejection head according to claim 1, wherein the pressurization energy generating element is capable of selecting a first driving mode in which the liquid in the second pressure chamber is pressurized and ejected from the hole and a second driving mode in which the liquid in the second pressure chamber is pressurized to an extent that the liquid is not ejected from the hole.

5. A liquid ejection apparatus comprising:

the liquid ejection head according to claim 1;

a supply unit configured to supply a liquid to the liquid supply path of the liquid ejection head; and a control unit configured to control the ejection energy generating element and the pressurization energy generating element.

6. The liquid ejection apparatus according to claim 5, wherein the control unit drives the pressurization energy generating element at least once 1 ms or more ahead of driving of the ejection energy generating element.

7. A liquid ejection head comprising:

a first pressure chamber and a second pressure chamber, one end portion of the first pressure chamber being connected to a liquid supply path through a first flow path, one end portion of the second pressure chamber being connected to the liquid supply path through a second flow path, the other end portion of the first pressure chamber and the other end portion of the second pressure chamber being communicated with each other by a communication path;

an ejection port allowing communication between the first pressure chamber and atmosphere;

a hole allowing communication between the second pressure chamber and atmosphere;

an ejection energy generating element provided in the first pressure chamber so that a liquid in the first pressure chamber is ejected from the ejection port; and a pressurization energy generating element provided in the second pressure chamber so that the liquid in the first pressure chamber is pressurized, wherein an opening area of the hole is smaller than an opening area of the ejection port, and wherein an inertial resistance at which the liquid in the second pressure chamber flows to the liquid supply path through the second flow path exceeds an inertial resistance at which the liquid in the second pressure chamber flows to the liquid supply path through the communication path, the first pressure chamber, and the first flow path.

8. A liquid ejection head comprising:

a first pressure chamber and a second pressure chamber, one end portion of the first pressure chamber being connected to a liquid supply path through a first flow path, one end portion of the second pressure chamber being connected to the liquid supply path through a second flow path, the other end portion of the first pressure chamber and the other end portion of the second pressure chamber being communicated with each other by a communication path;

an ejection port allowing communication between the first pressure chamber and atmosphere;

a hole allowing communication between the second pressure chamber and atmosphere;

an ejection energy generating element provided in the first pressure chamber so that a liquid in the first pressure chamber is ejected from the ejection port; and a pressurization energy generating element provided in the second pressure chamber so that the liquid in the first pressure chamber is pressurized, wherein an opening area of the hole is smaller than an opening area of the ejection port, and wherein an inertial resistance of the liquid in the second flow path is at least 1.5 times an inertial resistance of the liquid in the first flow path.

9. A liquid ejection head comprising:

a first pressure chamber and a second pressure chamber, one end portion of the first pressure chamber being connected to a liquid supply path through a first flow path, one end portion of the second pressure chamber being connected to the liquid supply path through a second flow path, the other end portion of the first pressure chamber and the other end portion of the second pressure chamber being communicated with each other by a communication path;

an ejection port open to the first pressure chamber;

a hole open to the second pressure chamber;

an ejection energy generating element provided in the first pressure chamber so that a liquid in the first pressure chamber is ejected from the ejection port; and a pressurization energy generating element provided in the second pressure chamber so that the liquid in the first pressure chamber is pressurized, wherein an opening area of the hole is smaller than an opening area of the ejection port, and wherein an inertial resistance of the liquid in the hole is at least 1.3 times an inertial resistance of the liquid in the ejection port.

10. The liquid ejection head according to claim 9, wherein an inertial resistance at which the liquid in the second pressure chamber flows to the liquid supply path through the second flow path exceeds an inertial resistance at which the liquid in the second pressure chamber flows to the liquid supply path through the communication path, the first pressure chamber, and the first flow path.

11. The liquid ejection head according to claim 9, wherein an inertial resistance of the liquid in the second flow path exceeds an inertial resistance of the liquid in the first flow path.

12. The liquid ejection head according to claim 11, wherein the inertial resistance of the liquid in the second flow path is at least 1.5 times the inertial resistance of the liquid in the first flow path.

13. The liquid ejection head according to claim 9, wherein the second flow path is longer in distance than the first flow path.

14. The liquid ejection head according to claim 9, wherein the pressurization energy generating element is capable of pressurizing the liquid without ejecting the liquid in the second pressure chamber from the hole.

15. The liquid ejection head according to claim 9, wherein the pressurization energy generating element is capable of selecting a first driving mode in which the liquid in the second pressure chamber is pressurized and ejected from the hole and a second driving mode in which the liquid in the second pressure chamber is pressurized to an extent that the liquid is not ejected from the hole.

16. A liquid ejection apparatus comprising:

the liquid ejection head according to claim 9;

a supply unit configured to supply a liquid to the liquid supply path of the liquid ejection head; and a control unit configured to control the ejection energy generating element and the pressurization energy generating element.

17. The liquid ejection apparatus according to claim 16, wherein the control unit drives the pressurization energy generating element at least once 1 ms or more ahead of driving of the ejection energy generating element.

* * * * *